United States Patent [19]

Brisbin et al.

[11] Patent Number: 5,070,659

[45] Date of Patent: Dec. 10, 1991

[54] RETRACTABLE ROOF FOR STADIUM STRUCTURE

[75] Inventors: Brian Brisbin; Felim McCaffrey; Peter Sheffield, all of Toronto, Canada

[73] Assignee: Stadium Consultants International, Inc., Toronto, Canada

[21] Appl. No.: 582,387

[22] Filed: Sep. 14, 1990

Related U.S. Application Data

[63] Continuation of Ser. No. 474,553, Feb. 2, 1990, Pat. No. 4,995,203.

[51] Int. Cl.[5] ..... E04B 1/34

[52] U.S. Cl. ..... 52/6; 52/64; 52/80

[58] Field of Search ..... 52/64–72, 52/80, 82, 6

[56] References Cited

U.S. PATENT DOCUMENTS

| | | | |
|---|---|---|---|
| 1,572,790 | 2/1926 | Grigsby | 52/67 |
| 2,728,115 | 12/1955 | Cornelius | 52/67 |
| 3,149,703 | 9/1964 | De Felice | 52/64 |
| 4,676,033 | 6/1987 | Allen et al. | 52/6 |
| 4,716,691 | 1/1988 | Allen et al. | 52/6 |
| 4,833,837 | 5/1989 | Bonneau | 52/66 |
| 4,995,203 | 2/1991 | Brisbin et al. | 52/6 |

FOREIGN PATENT DOCUMENTS

| | | | |
|---|---|---|---|
| 1529744 | 5/1968 | France | 52/65 |

*Primary Examiner*—James L. Ridgill, Jr.
*Attorney, Agent, or Firm*—Ridout & Maybee

[57] ABSTRACT

A structure is provided having two opposing nested pairs of outwardly convex roof arches mounted for rotation about a generally horizontal axis. Each pair of nested roof arches can be rotated about its axis from a lowered nested condition to a raised condition where the inner portion of one arch partially overlaps the other arch of the nested pair. In a preferred arrangement the arches extend between supports on diametrically opposing sides of a stadium building, which has an upper opening. The arches in their raised condition cover the stadium opening and in their lowered condition maintain the stadium substantially open to the elements. The turning moment exerted by the arches is sustained through struts by floats within liquid contained in caissons formed a foundation of the structure. The floats are shaped and guided to follow a path within the liquid as the association arch rotates such as to substantially balance the turning moment of the latter as they move. A double acting hydraulic cylinder arrangement is connected to the arches as a distance from the horizontal axes to move them between their raised and lowered positions.

9 Claims, 6 Drawing Sheets

RETRACTABLE ROOF FOR STADIUM STRUCTURE

REFERENCE TO RELATED APPLICATIONS

This application is a continuation of our co-pending application Ser. No. 07/474,553 filed on Feb. 2, 1990 now U.S. Pat. No. 4,995,203 and entitled Retractable Roof for Stadium Structure. The teachings of that application are incorporated herein by reference.

BACKGROUND OF THE INVENTION

1. Field of the Invention

The present invention relates to structures having a roof which may be opened and closed. In particular, the invention relates to a roof which is made of rigid panels which nest together when opened and which partially overlap when closed.

2. Revue of the Art

In an effort to provide a more enjoyable environment within a building, structures have been built having a roof which may be opened and closed. Stadium structures are especially well suited to such roof systems since spectators and players generally prefer to be exposed to sunlight and breezes but when the weather turns inclement a sheltered environment is preferred. Stadium structures having a fixed partial roof represent an increasingly unacceptable compromise between these two preferences and therefore stadiums having moving retractable roof panels have been developed. Although any building or enclosed space can be constructed having a retractable roof, over an atrium or promenade for example, economic considerations have dictated that large retractable roof structures be restricted to stadiums. Such a roof eliminates the need to cancel or reschedule games or concerts due to inclement weather and in addition the attendance at such events increases since spectators are more willing to attend if retractable shelter is provided.

An example of a stadium having a retractable rigid panel roof is the SkyDome TM stadium in Toronto, Canada as described in U.S. Pat. Nos. 4,676,033 issued June 30, 1987 and 4,716,691 issued Jan. 5, 1988. The SkyDome stadium has one fixed roof panel approximating a quarter spherical shell, and three moving roof panels which move upon rails positioned in a horizontal plane supported upon the upper portion of the stadium building. In the closed position, the roof panels form an egg-shaped roof having the fixed quarter spherical panel at one end and a moving quarter spherical panel at an opposite end with two arching panels in the middle portion of the roof. In the open position the roof panels are moved to nest within each other over the fixed roof panel. Since the roof panels of the SkyDome stadium move in a horizontal plane relatively little power is required to move the panels upon their bogie wheels, but the distance the panels must move and their movement sequence make the opening and closing process relatively slow.

Several disadvantages are apparent in the SkyDome type design. The roof structure is supported upon the upper portion of the stadium building requiring that a substantial portion of the stadium be constructed before commencing roof erection thereby lengthening construction schedules, and that the stadium building itself carries the roof loads. The roof panels must be erected at their final elevation requiring ironworkers and cranes to work at substantial elevations which inevitably reduce the speed of erection. When such a stadium is constructed in an area prone to earthquakes the stadium building and roof must both be interconnected and designed in such a way as to withstand significant accelerations and vibrations. Each panel should be designed to withstand earthquake loads in a partially or fully open position, as well as in a closed position.

A further disadvantage of such a roof structure is the presence of the fixed panel. Even when positioned to cast the least shadow possible, the retracted panels nested above the fixed panel still reduce the effect of the open roof in significant areas of the stadium. In order to fully retract the two middle panels, a track is built beyond the walls of the stadium and the middle panels extend beyond the stadium in their fully open position adding to the amount of land required to accommodate the structure.

SUMMARY OF THE INVENTION

The present invention relates to a novel structure and roof assembly which addresses the above discussed disadvantages of known retractable roof structures.

The invention provides a roof assembly comprising: a roof structure mounted for rotation about a generally horizontal axis between raised and lowered conditions such that the weight of the roof assembly generates a variable turning moment about said axis dependent on the stage of transition between said conditions, said roof structure in a raised condition covering an area and in a lowered condition uncovering said area; at least one strut, having upper and lower ends, the upper end being pivotally connected to said roof structure at a distance from said axis; a body of liquid adjacent the lower end of each strut; float means, connected to the lower end of each strut, such that displacement of liquid in said body applies a buoyant force to said roof structure through said strut opposite said turning moment when said float means is at least partially immersed in said body of liquid; guide means for constraining said float means to follow a path within said liquid as said roof structure rotates, such that the total buoyant force, applied through said at least one strut to the roof structure, substantially counterbalances said variable turning moment throughout the transition of the roof structure between its raised and lowered conditions; and actuating means for rotating said roof structure between said raised and lowered conditions.

The invention also extends to a structure comprising: a first pair of nested outwardly convex arches comprising a first arch and a second arch spaced from said first arch said first and second arches mounted for rotation about a first generally horizontal axis; and a second pair of nested outwardly convex arches comprising a third and a fourth arch spaced from said third arch, said third and fourth arches each mounted for rotation about a second generally horizontal axis parallel to said first axis, between raised and lowered conditions and each having an arcuate cross-section in a vertical plane normal to said first and second axes, said first and second arches and said third and fourth arches in their respective lowered conditions being in a nested pair configuration and in their respective raised conditions being in a configuration with the inner portion of said first arch partially overlapping the outer portion of said second arch and the inner portion of said third arch partially overlapping the outer portion of said fourth arch, said arches extending between opposing sides of an area;

means for supporting said arches in raised and lowered conditions; and actuating means for rotating said arches in raised and lowered conditions; whereby said first and second arches and said third and fourth arches are rotatable in opposite directions between an open position in which each is in its respective lowered condition and a closed position in which each is in its respective raised condition, the inner edges of said second and fourth arches engaging in said closed position.

The structure preferably includes a building structure within the enclosed area, the building preferably being a stadium which shares a common foundation with the means for supporting the arches but is otherwise structurally independent.

BRIEF DESCRIPTION OF THE DRAWINGS

In order that the invention may be readily understood, one embodiment of the invention will now be described below by way of an example with reference to the following drawings.

DETAILED DESCRIPTION

Figure 1:
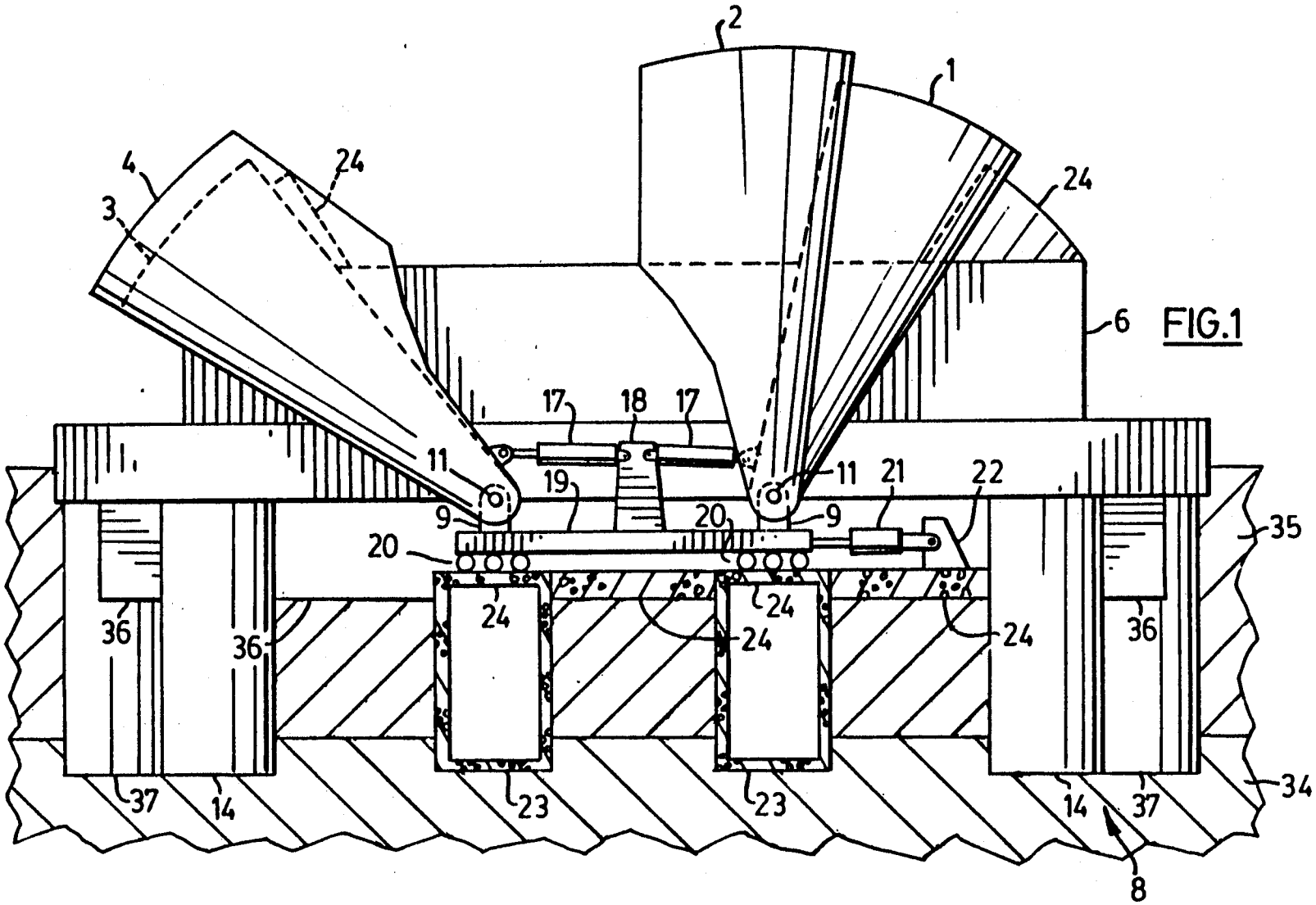
FIG. 1 is a sectional elevation view of a stadium on the line 1—1 in FIG. 2, showing a roof structure in a lowered position on the left and in a raised position on the right.
Figure 2:
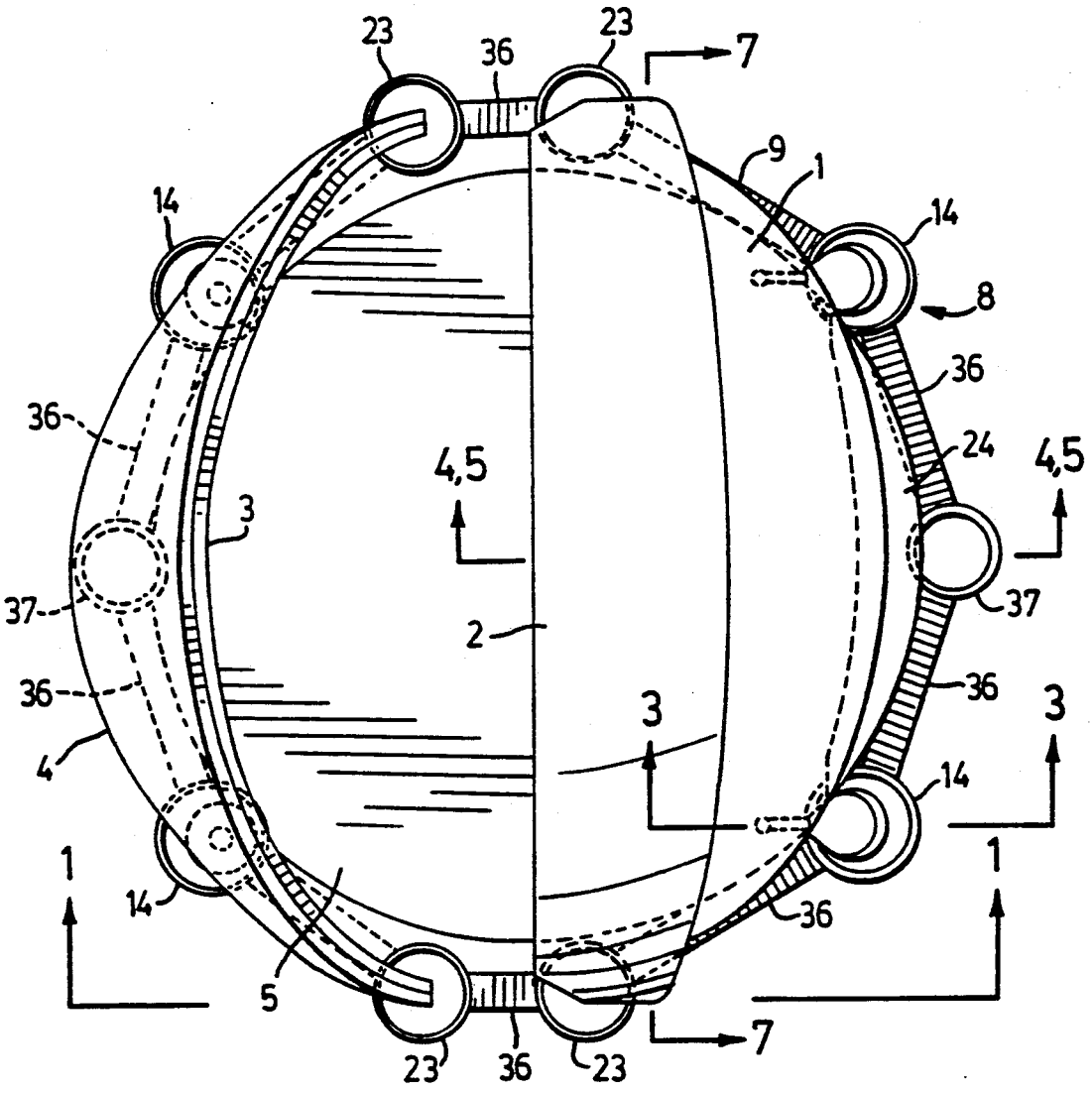
FIG. 2 is a plan view of the stadium with the roof structure positioned as in FIG. 1.

A structure in accordance with a preferred embodiment of the invention is illustrated in FIGS. 1 and 2, and has first and second spaced outwardly convex roof arches 1 and 2 forming a first associated nesting pair, and third and fourth spaced outwardly convex roof arches 3 and 4 forming a second associated nesting pair. Each nesting pair extends between supports on opposing sides of an area 5 to be covered or enclosed and is mounted for rotation about a generally horizontal axis between raised and lowered conditions, the axes of the two pairs being parallel and adjacent. Referring to FIG. 1 the first and second arches 1 and 2 are shown in their respective raised conditions and the third and fourth arches 3 and 4 are shown in their lowered conditions. Within the area bounded by the arches is constructed a stadium building structure 6 having an open upper portion which is covered when the arches are rotated to a closed position and which is uncovered when the arches are rotated to an open position.

Figure 4:
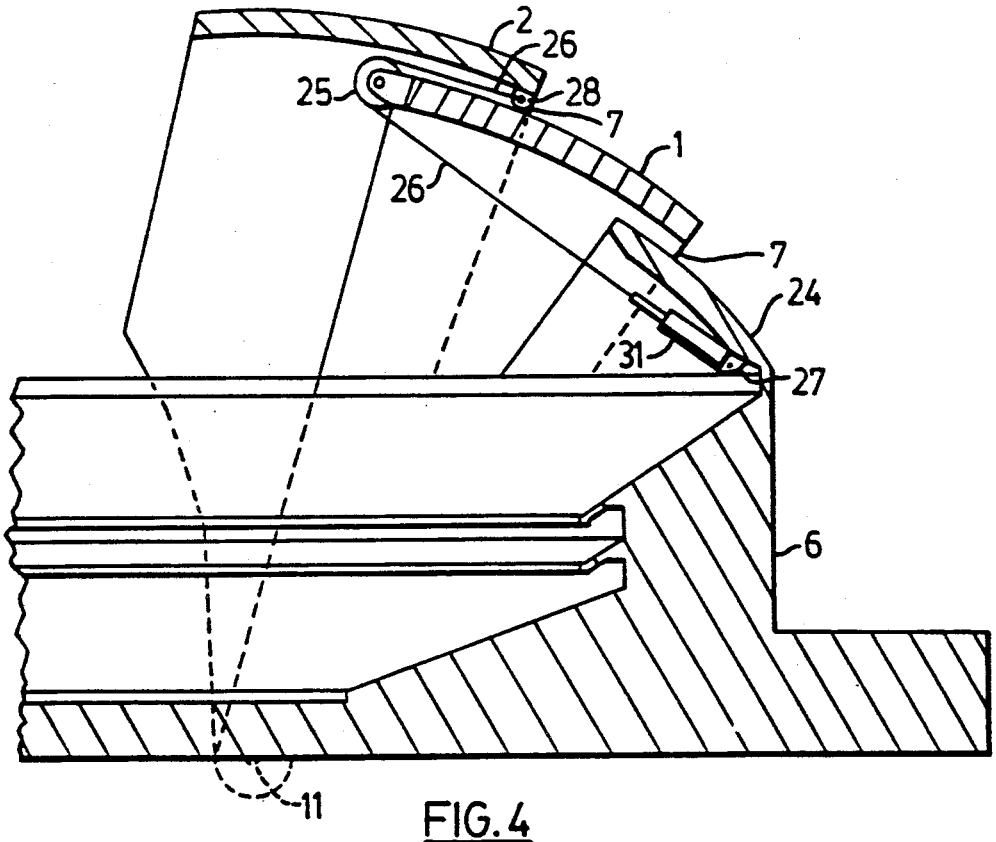
FIGS. 4 and 5 are sectional views along line 4, 5—4, 5 of FIG. 2 showing respectively coordinating means coupling the arches and interlocking means acting between the arches.
Figure 5:
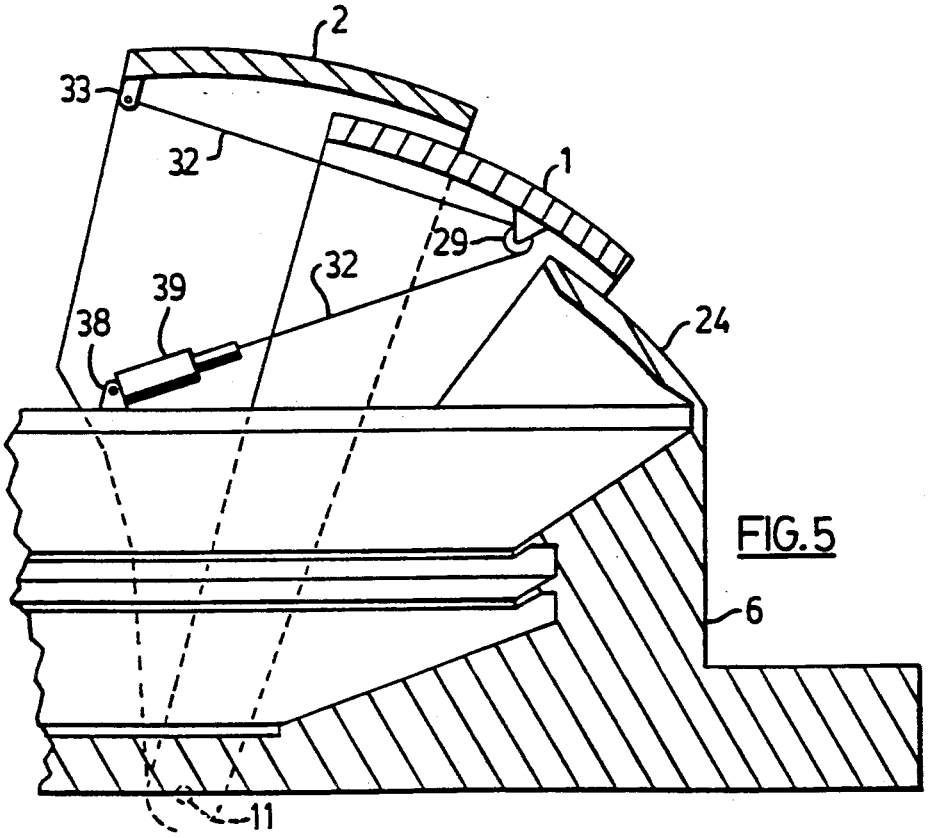

As best illustrated in FIGS. 4 and 5 each arch of a nesting pair has an arcuate cross-section in a vertical plane normal to the axis of rotation such that the arches of each pair nest together in the lowered position and are able to rotate relative to each other to the raised position while maintaining a gap 7 between the nested arches which should be sufficient to accommodate differential arch deflection. The nesting pairs formed by the first and second arches 1 and 2 and the third and fourth arches 3 and 4 have their arches fully nested in a lowered condition, whilst in their respective raised conditions their arches are in a configuration with the inner portion of the first arch 1 partially overlapping the outer portion of the second arch 2 and the inner portion of the third arch 3 partially overlapping the outer portion of the fourth arch 4. The means for supporting the arches in the raised and lowered conditions and actuating means for rotating the arches are described in detail below. The first and second arches 1 and 2 forming the first pair, and the third and fourth arches 3 and 4 forming the second pair, are rotatable in opposite directions to an open position surrounding the enclosed area 5 in their respective lowered conditions, and to a closed position covering the enclosed area 5 when in their respective raised conditions. The inner edges of the second and fourth arches 2 and 4 engage in the closed position such that the area 5 below the arches is wholly enclosed.

Figure 7:
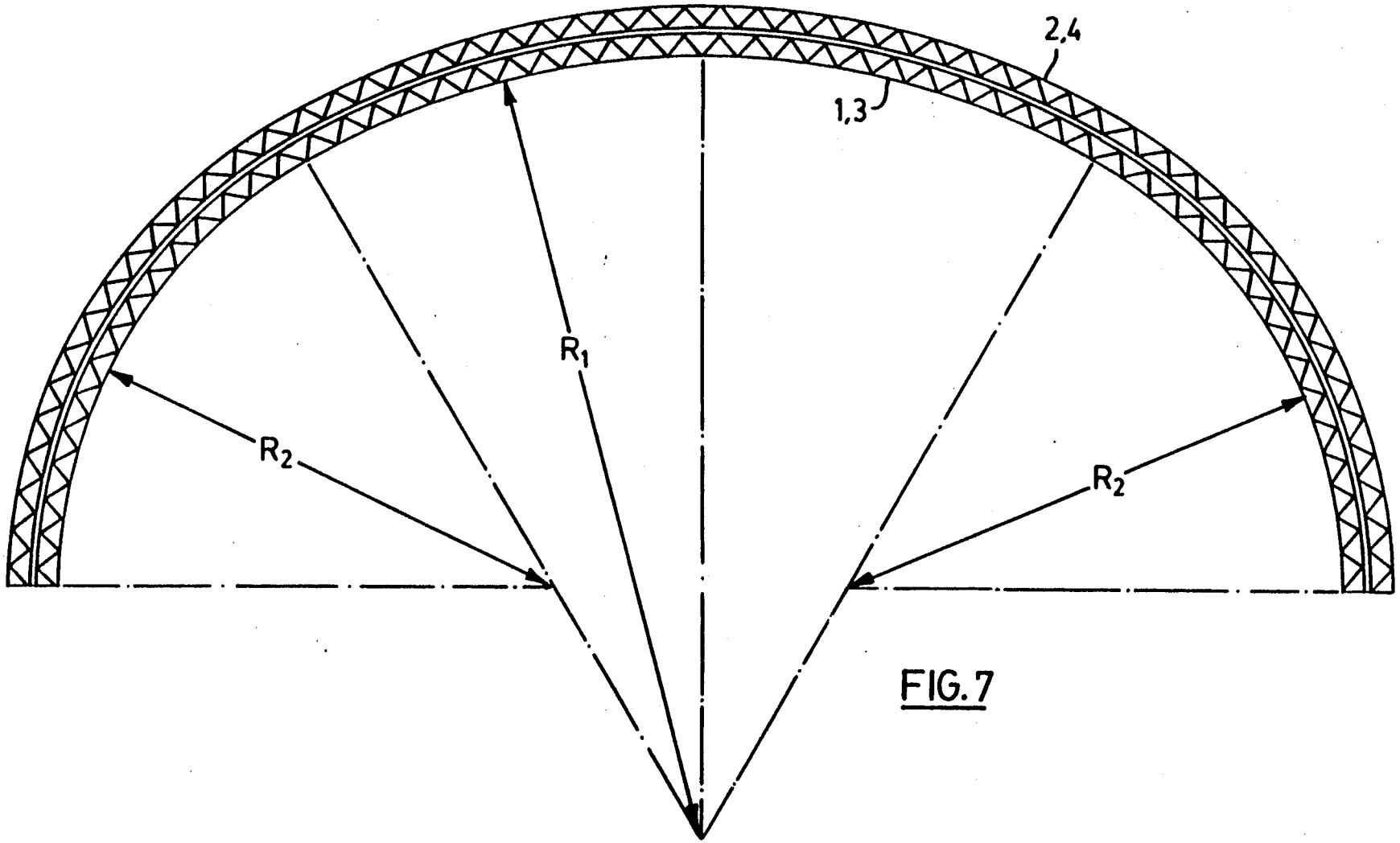
FIG. 7 is a sectional view along line 7—7 of FIG. 2 showing the approximate configuration of the nested arches.

As best shown in FIGS. 4 and 5, a structure according to the invention may include a building structure 6 such as a stadium within the area enclosed by the arches. Referring to FIG. 1 the building structure 6 includes foundations 8 and an upper portion supported upon the foundations 8. The arches are supported independently of the upper portion of the building structure 6 thereby reducing the loads imposed on the building structure 6 and its resultant cost. The arches may be constructed in any form which permits an acceptable structural strength as required by the configuration of the space to be enclosed or the shape of the building structure 6. In the example shown in the drawings the arches approximate to a semi-ellipse as shown in FIG. 7, and have a central portion of a first radial curvature, $R_1$ and inner portions of a second radial curvature, $R_2$ the first curvature $R_1$ being greater than the second curvature $R_2$.

Figure 3:
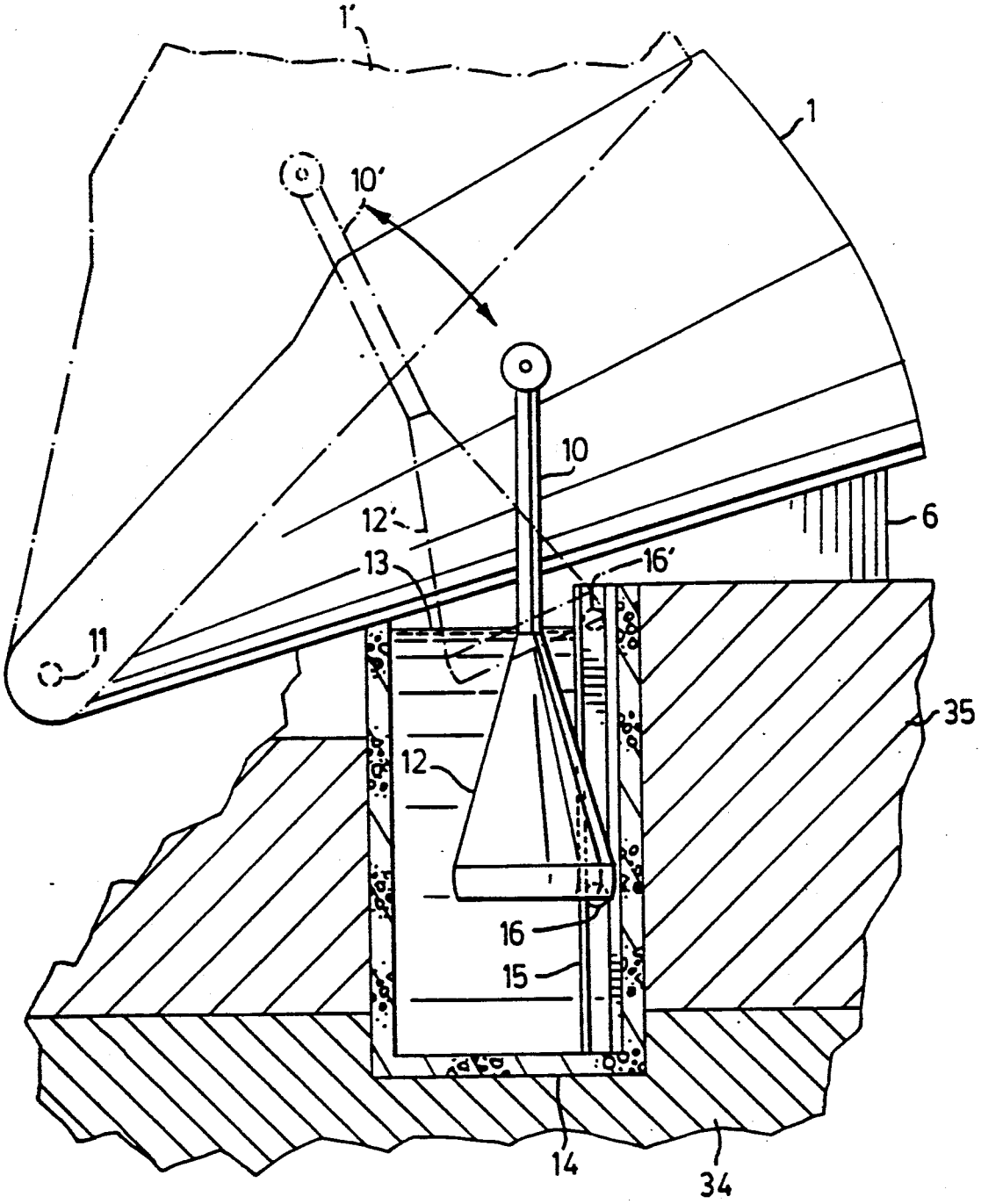
FIG. 3 is a detail sectional view of the means for supporting the roof structure along line 3—3 of FIG. 2.

Referring to FIG. 3, the means for supporting the arches and the actuating means for rotating the arches between a raised and a lowered condition are illustrated. It will be understood that many forms of roof structure, including a pair of nested arches as described above, may be mounted for rotation about a horizontal axis between raised and lowered conditions and therefore the means for supporting and the actuating means may be applied to various forms of roof structures other than the arches described. Accordingly, the following description relates to means for supporting and actuating elements movable about horizontal axes for forming an opening roof assembly. In a preferred embodiment this assembly includes a roof structure in the form of nesting pairs of arches each having an outwardly convex first arch 1 mounted for rotation upon pivot mounts 9 at its ends and a second arch 2 spaced radially outwardly from the first arch 1. The second arch 2 is also mounted for rotation about the same horizontal axis and the first and second arches 1 and 2 have an arcuate cross-section in a vertical plane normal to the axis.

For the sake of clarity the second arch 2 is not shown in FIG. 3. The coordinating means by which the second arch 2 is rotated will be described in detail below. Since the nesting pair of arches is mounted for rotation about a generally horizontal axis between raised and lowered conditions, the weight of the arches generates a turning moment about the axis which varies according to the position of the arches. This turning moment is variable dependent on the stage of transition between the raised and lowered conditions as the horizontal distance from the axis to the centre of gravity of the roof assembly changes.

Referring to FIG. 3, the first arch in its lowered and raised positions is referred to as 1 and 1' respectively. Other elements are likewise identified in these positions.

The means for supporting the structure formed by the nested pair of arches includes at least one strut 10 having its upper end pivotally connected to the roof structure 1 at a distance from the axis 11. The lower end of the strut 10 is connected to a float 12 which in a preferred embodiment is a hollow rigid vessel. A liquid 13, normally water, which is displaced by the float 12 applies a buoyant force through the float 12 and the strut 10 to the roof structure 1. The buoyant force is such as to apply a moment opposite and approximately equal to the turning moment of the roof structure 1 when the float 12 is at least partially immersed in a body of the liquid 13 adjacent the lower end of each strut 10. Since the turning moment varies dependent on the stage of transition of the structure between its raised and lowered conditions, the moment applied by the buoyant force is arranged to vary correspondingly to substantially counterbalance that generated by the weight of the roof structure. To this end the float 12 may have a horizontal cross-sectional area which varies so as to control the manner in which the buoyant force (equal to the weight of liquid 13 displaced) varies with the vertical position of the float 12 as it follows a defined path within the liquid 13. In the preferred embodiment illustrated, the float 12 is an approximation to a cone since the buoyant force resulting from the volume of water 13 displaced by such a float 12 in the arrangement shown approximately counterbalances the weight of the particular roof structure illustrated. Depending upon the variations in the turning moment of the roof structure chosen, the path of movement which the float 12 is constrained to follow, and variations in level of the liquid 13 occasioned by movement of the float 12 or otherwise, the shape of the float 12 may be varied so as to provide the desired counterbalancing action.

Since the strut 10 applies forces to the float 12 normal to the axis of rotation and the float 12 is laterally unstable in the liquid 13, guide means are required for sustaining these forces and constraining the float means to follow the defined path within the liquid 13 as the roof structure 1 rotates. The liquid may be contained within a tank or float caisson 14 having bottom and side walls as illustrated and may include liquid storage means and means for connecting the liquid storage means to the tank or float caisson 14. As the float follows a path within the body of liquid, the liquid displaced may be conducted to the liquid storage. In a preferred embodiment the guide means comprises a vertical rail 15 connected to a side wall of the float caisson 14 and roller assemblies 16 connected to the float means 12 and engaging the rail 15. The rollers 16 enable the float 12 to be raised and lowered along a vertical path within the float caisson 14 without engaging the caisson side wall, and prevent the float 12 from moving laterally in a direction normal to the vertical path. The roller assemblies 16 may comprise primary rollers bearing upon a cap of the rail 15 together with secondary rollers engaging side of the rail 15 to prevent lateral movement.

Referring to FIGS. 1 and 3, actuating means are shown for rotating the roof structure between its raised and lowered conditions. In a preferred embodiment the actuating means comprise a double-acting double rod hydraulic cylinder 17 mounted upon a first support 18 and connected to the roof structure 1 at a distance from the axis 11. In operation, therefore, the float 12 substantially counterbalances the weight of the roof structure while the hydraulic cylinder 17 provides an actuating force to rotate the roof structure. It will be apparent to those skilled in the art that actuating means of various other types may be utilized within the ambit of this invention. For example, actuating means such as a pump could be provided to pump water 13 in and out of the float 12 and/or the tank 14 thereby actuating the roof structure to rotate.

In a preferred embodiment shown in FIGS. 1 and 2, the roof structure 1 extends between opposing sides of an area 5 and the roof structure is mounted upon pivot mounts 9 disposed on opposite sides of the area 5. The pivot mounts 9 may comprise an axle and bearings although other appropriate forms of pivotal mounting well known to those skilled in the art may be applied. A particularly advantageous feature of the invention is the capability of the roof and stadium structure to independently move in response to earthquake loads, as well as the capability of the relatively flexible roof structure to respond to earthquake loads minimizing excessive deflections and stresses. The pivot mounts 9 may be mounted upon dampening means for dampening the propagation of earthquake forces and for allowing relative movement between the roof structure support and the roof structure. The roof structure support shown in FIG. 1 includes two pivot caissons 23 upon which a reinforced concrete cap 24 is supported. The cap 24 provides a generally horizontal plane upon which the arches and dampening means are accommodated. The dampening means include a horizontally displaceable platform 19 upon which the pivot mounts 9 and the actuating means 17 and 18 are mounted. The base of the platform 19 is supported by lateral translating means 20 which allow the platform to move laterally in a horizontal plane upon the cap 24. The lateral translating means 20 may be rollers as illustrated or may be combined with the damping means in the form of elastomeric pads reinforced in a manner well known. If rollers are used at least one double-acting hydraulic damping means 21 is mounted to a fixed support 22 upon the cap 24. The damping means 21 engages the platform with its opposite end. For the sake of clarity only one damping means 21 is shown but it will be understood that more than one such damping means 21 may be employed in any combination required to dampen the lateral displacement of the platform 19. Hydraulic pressure control means of known design are connected to the chambers of the damping means 21 to control the hydraulic pressure whereby the lateral movement of the platform 19 may be controlled in response to earthquake loads. During earthquakes sensors of the control means detect a relative movement between the cap 24 and the platform and the hydraulic pressure is instantaneously modified in response to dampen the effect of earthquake loads upon the arches. A particular advantage of such roof structures is that the roof structure and any associated enclosed building 6 are independent structures so that the building 6 and roof may resist earthquake forces independently, substantially reducing the stresses induced in such buildings 6 when compared to those having roofs supported upon the building 6. The movement of the relatively flexible roof structure upon the dampening means during earthquakes reduces the stresses and deflections and results in a relatively light weight roof structure when compared to conventional retractable roof structures.

As described above, a preferred roof assembly includes a first and a second arch 1 and 2 mounted as a nesting pair for rotation about a horizontal axis and may include a further pair of oppositely moving third and fourth arches 3 and 4. Referring to FIG. 4, coordinating means for the arches of a nested pair are shown, the pair in this case consisting of the first and second arches 1 and 2. The coordinating means are coupled to the first and second arches 1 and 2 for rotating the second arch 2 as the first arch 1 rotates. The second arch 2 rotates at a second angular velocity which differs from a first angular velocity at which the first arch 1 rotates. In the particular embodiment illustrated, the second angular velocity is approximately twice the first angular velocity as a result of the coordinating means provided. The building 6 may have a fixed roof panel 24 over a segment of the stadium. The coordinating means comprise a cable and sheave system including a first cable sheave 25 connected to the inner edge of the first arch 1 at a distance from the axis 11 and a first cable 26. The first cable 26 has one end attached to a third support 27 and an opposite end attached to a first bracket 28 at the outer edge of the second arch 2 at a distance from the axis 11. The middle portion of the first cable 26 is reeved over the first cable sheave 25. In operation, therefore, as the first arch 1 is rotated under the forces applied by the floats 12 and hydraulic cylinders 17, the first cable 26 pulls the second arch 2 as the first arch 1 rotates toward its erected position. The third support 27 includes a first tensile hydraulic cylinder 31. The first cable 26 is attached to the rod of the first tensile cylinder 31 and the first tensile cylinder 31 is pivotally mounted to a bracket on the fixed roof panel 24. Hydraulic pressure control means are connected to the pressurized chamber of the first tensile cylinder 31. The pressure within such chamber is controlled to maintain a tension induced in the first cable which may be varied in response to earthquake loads and movement of the fixed roof panel 24.

Since the second arch 2 may be subjected to severe wind forces interlocking means are provided for preventing the first and second arches 1 and 2 from rotating independently of the other during heavy winds. In the particular embodiment illustrated in FIG. 5 the interlocking means comprise a second cable sheave 29 connected to the concave surface of the first arch 1. A second cable 32 has a first end attached to a bracket 33 on the second arch 2 adjacent its inner edge and has a second end attached to a fourth support 38. The second cable 32 is reeved over the second cable sheave 29 and the fourth support 38 is inward of the second cable sheave 29. Taken together with the coordinating means shown in FIG. 4 and described above it is apparent that the second arch 2 may rotate at approximately twice the angular velocity of the first arch 1, and that the first and second arches 1 and 2 may not rotate independently under severe wind forces for example. The fourth support includes a second tensile hydraulic cylinder 39 which has its rod attached to the second cable 32. The second tensile cylinder 39 is pivotally mounted to a fixed portion of the stadium building 6. Hydraulic pressure control means connect to the pressurized chamber of the second tensile cylinder 39. The pressure within such chamber is controlled to maintain a tension induced in the second cable 32 which may be varied in response to earthquake loads and movement of the stadium building 6.

Figure 6:
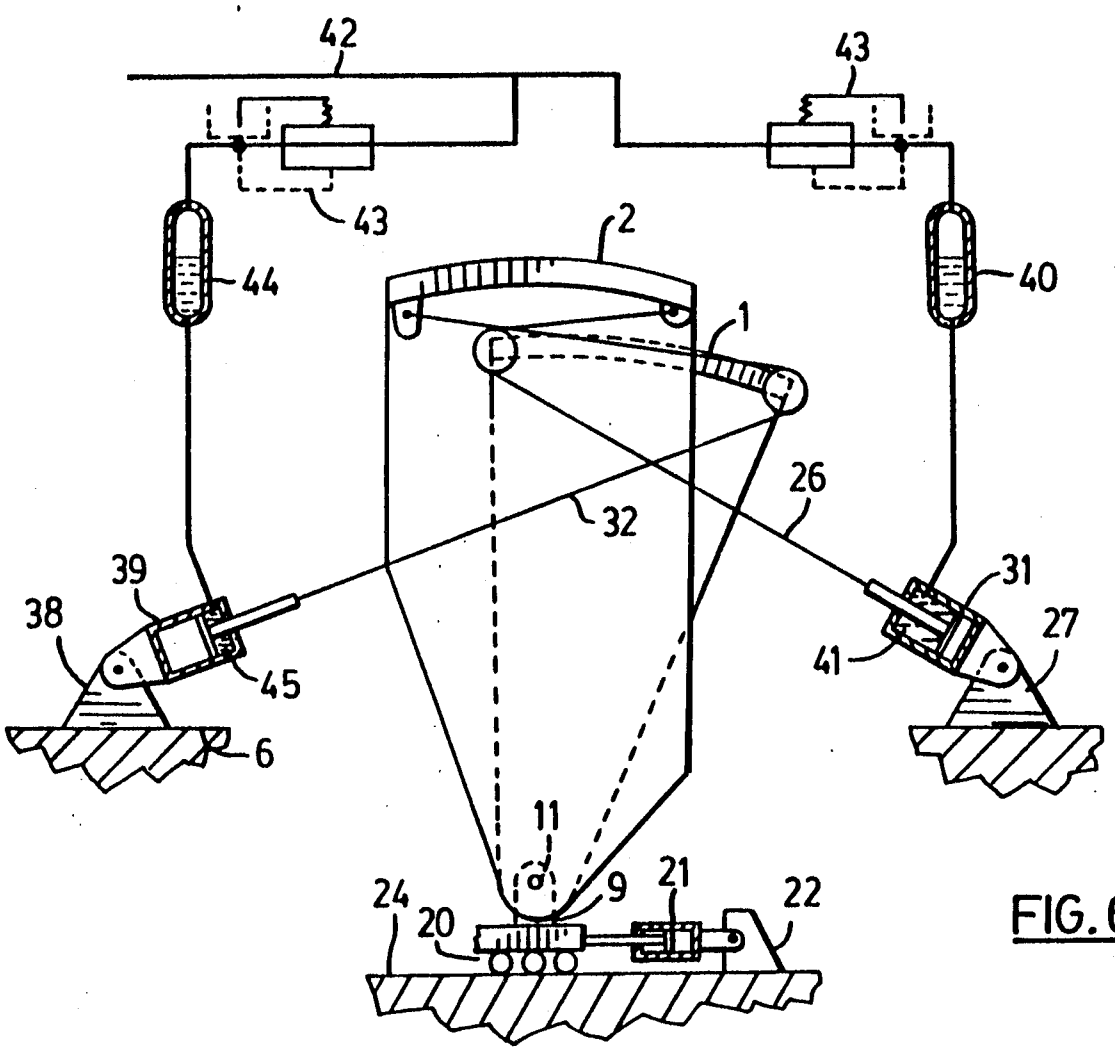
FIG. 6 is a schematic diagram illustrating the hydraulic-pneumatic earthquake dampening mechanism of the coordinating and interlocking means.

Referring to FIG. 6, a schematic diagram of the hydraulic control means is shown, together with the cooperating means and interlocking means connected to the arches 1 and 2. A first accumulator 40 is connected to the pressurized chamber 41 of the first tensile cylinder 31. The first accumulator 40 has its pressure maintained by the connection of a pressurized nitrogen gas supply line 42 with known in line regulator, check valve and sump means 43. In a like manner, a second accumulator 44 is connected to the pressurized chamber 45 of the second tensile cylinder 39. The second accumulator 44 also has its pressure maintained by connection to a pressurized nitrogen line 42. The tension induced in the first cable 26 is greater than the maximum cable force exerted by the wind but less than the maximum force exerted by an earthquake. As a result, the first tensile cylinder 31 acts as a fixed anchor under all circumstances except when subjected to earthquake loadings. The tension induced in the second cable 32 is less than the tension induced in the first cable 32. The pressure within the pressurized chamber 45 of the second tensile cylinder 39 is maintained at a level to allow the second cylinder's rod to move to compensate for temperature effects and rope geometry effects. It will be understood that the coordinating means and interlocking means may include a plurality of cables and sheaves as described above acting in parallel. The determination of the number of such parallel cables and sheaves depends upon the arch span, cable strength and other parameters within the structural designer's scope. In the interest of clarity however, the drawings and description have been limited to a single cable and sheave system.

Referring to FIGS. 1 and 2, the building structure 6 or stadium comprises foundations 8 and an upper portion supported upon the foundations 8. The foundations 8 for such large structures must bear upon a stable soil or rock stratum which is capable of supporting the building and roof structure. In practice, many stadium sites are located in port areas, tidal flats, former river beds or reclaimed land in or adjacent large cities since the large area of land required for such a structure is otherwise not available. Therefore stadium sites have generally poor foundation conditions due to land fill, organic deposits, or nonconsolidated soil in the upper soil strata. As a result, the foundations 8 must extend to deeper more stable load bearing strata. In FIG. 1, foundations 8 are depicted bearing upon a stable soil stratum 34 passing through an unstable soil stratum 35. The unstable stratum 35 applies a surcharge load to the stable stratum 34 and may apply vertical frictional loads to the sides of the foundations 8 but is otherwise generally not relied upon to support the building or roof structure due to its relatively low strength. Such foundations as described below may of course be constructed where more favourable foundation conditions exist. In such a case, the determining factor is the function the excavated space is to perform within the foundation.

The foundations 8 illustrated have a number of cylindrical reinforced concrete caissons 23, 14 & 37 adjacent the periphery of the stadium building 6. The caissons are joined together to provide the foundation 8 by a number of rigid beams 36 spanning between adjacent caissons about the periphery. The beams 36 support a platform 9 for the upper portion of the stadium building and transmit the resultant loads to the caissons which bear upon the stable stratum 34. The caissons may be constructed by any appropriate technique. The upper portion of the stadium structure is then constructed upon the foundation formed by the beams 36 and the caissons.

It will be appreciated from the foregoing description that the interior of at least some of the caissons is utilized to house components of the roof assembly. In FIG. 2, a foundation 8 is shown having ten caissons joined in a peripheral ring by beams 36. Depending upon the design of the stadium building and roof structure various other foundation arrangements will be apparent within the scope of this invention.

The first and second arches 1 and 2 of the first nested pair and the third and fourth arches 3 and 4 of the second nested pair are mounted for rotation about a first and second axis respectively upon four pivot mounts 9. As described above the pivot mounts 9 are supported upon dampening means to allow lateral displacement of the arches during earthquakes.

As shown in FIG. 2 four hollow float caissons 14 are each utilized as containment vessels for the liquid 13 within which a float 12 is immersed. The float caissons 14 have side and bottom walls, the side wall of which support the rail 15 for guiding the float 12. Large volumes of water are displaced as the float 12 follows a path within the body of liquid in the float caisson. In addition, in order to maintain the float, rails and contents of the float caisson, it is desirable to provide means to remove water from and regulate the level of water in the float caissons. Referring to FIG. 2 support caissons 37 are shown which have a primary function of supporting the stadium building 6 but due to their excavated interior they may also be used for liquid storage. The hollow support caissons 37 have a central storage cavity which may be used as liquid storage means. A number of liquid conduits communicate between the interiors of the float caissons 14 and the cavities of the support caissons 37. Pumps communicate with the conduits for pumping liquid between the interior of the float caissons 14 and the cavities of the support caissons 37.

Referring to FIGS. 1 and 3, the buoyant force applied by the floats 12 may exceed that required to balance the variable turning moment resulting in the arches being biased toward an erected condition. When the buoyant force substantially counterbalances the variable turning moment, the actuating hydraulic cylinders 17 act in tension to erect the arches and act in compression to lower the arches. The actuating hydraulic cylinders 17 are each controlled by known means to maintain alignment and prevent tension of the arches.

The inner edges of the second and fourth arches 2 and 4 engage when both are in their fully raised positions. Means are provided to seal the joint and the arches 2 and 4 are mechanically locked together by releasable means. Arches 1 and 2 and arches 3 and 4 may also be mechanically locked together by releasable means. Spring bumpers are provided between arches 1 and 3 and the stadium building 6 to absorb the impact of earthquake loads. In the fully raised and locked condition, the roof assembly is exceptionally strong in comparison to conventional retractable roof assemblies especially in resisting earthquake loads. Means are also provided to mechanically lock the arches in their fully lowered conditions in order to resist movement during earthquakes.

We claim:

1. A structure comprising:

a first pair of nested outwardly convex arches comprising a first arch and a second arch spaced from said first arch, said first and second arches mounted for rotation about a first generally horizontal axis; and a second pair of nested outwardly convex arches comprising a third and a fourth arch spaced from said third arch, said third and fourth arches mounted for rotation, about a second generally horizontal axis parallel to said first axis, said arches being movable between raised and lowered conditions and each having an arcuate cross-section in a vertical plane normal to said first and second axes, said first and second arches and said third and fourth arches in their respective lowered conditions being in a nested pair configuration, the inner edges of the second and fourth arches defining an unobstructed opening and in their respective raised conditions being in a configuration with the inner portion of said first arch partially overlapping the outer portion of said second arch and the inner portion of said third arch partially overlapping the outer portion of said fourth arch, said arches extending between opposing sides of an area;

means for substantially counterbalancing the moment resultant from the weight of each of said arches in transition between their respective raised and lowered conditions; and actuating means for rotating said arches between raised and lowered conditions;

whereby said first and second arches and said third and fourth arches are rotatable in opposite directions between an open position in which each is in its respective lowered condition and a closed position in which each is in its respective raised condition, the inner edges of said second and fourth arches engaging in said closed position and defining an unobstructed opening when not in said closed position.

2. A structure according to claim 1 further comprising a building structure within said area, said area being covered when said arches are rotated to said closed position and said area being uncovered when said arches are rotated to said open position.

3. A structure according to claim 1 wherein said building structure comprises a stadium.

4. A structure according to claim 1 wherein said building structure comprises foundations and an upper portion supported upon said foundations, and wherein said arches are supported independently of said upper portion.

5. A structure according to claim 1 wherein said arches are configured to enclose a volume shaped appropriately for the function of the structure.

6. A structure according to claim 1 wherein said arches approximate a semi-ellipse having a central portion of a first radial curvature and inner portions of a second radial curvature, said first curvature being greater than said second curvature.

7. A stadium having an opening roof, comprising:

a foundation structure;

an open stadium built upon the foundation structure;

a roof structure comprising multiple shells each shell mounted for rotation about an associated substantially horizontal axis between an open position adjacent the periphery of the stadium and a closed position covering the stadium the inner edges of the shells defining an unobstructed opening when not in said closed position; and means for carrying the roof structure, including pivotal mountings for said shells, means for counterbalancing the moment resultant from the weight of each of the shells in transition between their respective open and closed positions, and means for rotating the shells between open and closed positions, said roof structure and means for carrying the roof structure on the one hand, and said stadium on the other hand, being independent structures each supported by said foundation structure.

8. A stadium according to claim 7, wherein the foundation structure comprises a plurality of caissons and a platform supported by said caissons, said open stadium being built upon the platform, and said means for carrying the roof structure being supported in at least some of the caissons.

9. A stadium according to claim 8, wherein the means for carrying the roof structure comprise said pivotal mountings supported by structure in certain of said caissons, liquid contained in certain other of the caissons, and floats in the liquid providing additional supports sustaining turning moments of said shells about said pivotal mountings.

* * * * *